US008720868B2

(12) United States Patent
Kim

(10) Patent No.: US 8,720,868 B2
(45) Date of Patent: May 13, 2014

(54) HUMIDIFICATION APPARATUS AND DISC ASSEMBLY THEREOF

(75) Inventor: Jung Ho Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 356 days.

(21) Appl. No.: 12/805,679

(22) Filed: Aug. 12, 2010

(65) Prior Publication Data

US 2011/0049732 A1 Mar. 3, 2011

(30) Foreign Application Priority Data

Aug. 27, 2009 (KR) ..... 10-2009-0079708

(51) Int. Cl.
*B01F 3/04* (2006.01)

(52) U.S. Cl.
USPC ..... 261/30; 261/92

(58) Field of Classification Search
USPC ..... 261/28, 30, 91, 92
See application file for complete search history.

(56) References Cited

U.S. PATENT DOCUMENTS 3,171,600 A * 3/1965 Eckey ..... 239/220
3,761,059 A * 9/1973 Rothert et al. ..... 366/316
3,886,074 A * 5/1975 Prosser ..... 210/150
4,185,687 A * 1/1980 Stockman ..... 165/8
8,066,263 B1 * 11/2011 Soderlund ..... 261/92
2011/0084414 A1 * 4/2011 Ahn et al. ..... 261/91
2011/0084415 A1 * 4/2011 Kim et al. ..... 261/92

FOREIGN PATENT DOCUMENTS

JP 2008-224188 9/2008
JP 2009-41796 2/2009
KR 10-2001-0078986 8/2001

OTHER PUBLICATIONS

Machine Translation of Japanese Application No. 2008-224188 (39 pages), May 2013.

* cited by examiner

*Primary Examiner* — Charles Bushey
(74) *Attorney, Agent, or Firm* — Staas & Halsey LLP

(57) ABSTRACT

Disclosed herein are a humidification apparatus having a disc assembly, and a disc assembly thereof. The disc assembly includes at least one disc member assembled by stacking, a first clamp disposed at one side of the at least one disc member, and a second clamp disposed at the other side of the at least one disc member. Each of the at least one disc member includes at least one recess part indented on the edge thereof, and the first clamp includes at least one recess connection part inserted into the at least one recess part so as to prevent movement of the at least one disc member.

11 Claims, 11 Drawing Sheets

HUMIDIFICATION APPARATUS AND DISC ASSEMBLY THEREOF

CROSS-REFERENCE TO RELATED APPLICATIONS

This application claims the benefit of Korean Patent Application No. 2009-0079708, filed on Aug. 27, 2009 in the Korean Intellectual Property Office, the disclosure of which is incorporated herein by reference.

BACKGROUND

1. Field

Embodiments relate to an evaporative type humidification apparatus having a disc assembly.

2. Description of the Related Art

In general, humidification apparatuses are used to maintain indoor humidity at a proper level and to prevent various respiratory diseases.

Humidification apparatuses are operated by various humidifying methods. Among humidification apparatuses operated by various humidifying methods, an evaporative type humidification apparatus, in which air is discharged to the outside through discharge holes via a disc assembly soaked in water so as to achieve humidification, has recently been proposed.

Such a humidification apparatus achieves humidification using the disc assembly as a humidification element. However, the conventional disc assembly has a complicated structure, thus causing user inconvenience in disassembly and assembly thereof during cleaning.

Further, the disc assembly has many coupling parts to assemble the disc assembly, and thus an air flow in the humidification apparatus is not smooth.

SUMMARY

Therefore, it is one aspect to provide a humidification apparatus having a disc assembly, which is easily assembled and disassembled.

It is another aspect to provide a humidification apparatus, in which an air flow is smooth.

Additional aspects will be set forth in part in the description which follows and, in part, will be apparent from the description, or may be learned by practice of the invention.

The forgoing and/or other aspects are achieved by providing a humidification apparatus including a main body, a tub unit to contain water, a disc assembly rotated when a part of the disc assembly is disposed in the tub unit, and an air blower device to blow air to the disc assembly, wherein the disc assembly includes a member, a first clamp disposed at one side of the at least one disc member, and a second clamp disposed at the other side of the at least one disc member, and the disc member including a recess part indented on the edge thereof.

The first clamp may include at least one recess connection part corresponding to the shape of the at least one recess part.

Each of the at least one recess connection parts may include a disc member fixing part protruding in the stacking direction of the at least one disc member, and a screw connection part formed within the disc member fixing part such that a screw may be connected thereto.

The second clamp may include at least one screw hole formed corresponding to the position of the screw connection part, and the disc assembly may further include at least one screw connected to the at least one screw connection part via the at least one screw hole.

Each of the at least one disc members may further include a through hole formed at one position on the surface thereof, and the first clamp may include a through hole connection part protruding in the stacking direction of the at least one disc member so as to pass through the through hole.

The first clamp may further include a connection rod receipt part depressed into the through hole connection part, and the second clamp may include a connection rod inserted into the connection rod receipt part.

The connection rod may be provided with a tapered part at the tip thereof so as to be easily inserted into the connection rod receipt part.

The foregoing and/or other aspects are also achieved by providing a disc assembly of a humidification apparatus including a plurality of disc members assembled by stacking, and a first clamp and a second clamp respectively disposed at first and second sides of the plurality of disc members to fix the plurality of disc members, wherein each of the plurality of disc members includes a recess part indented on an edge thereof to be connected to the first clamp, and the first clamp includes recess connection part inserted into the recess part to prevent movement of the plurality of disc members.

Each of the at least one recess connection parts may include a screw connection part formed such that a screw may be connected thereto, the second clamp may include at least one screw hole formed corresponding to the position of the least one screw connection part, and the plurality of disc members may be connected with the first clamp and the second clamp by connecting at least one screw to the at least one screw connection part via the at least one screw hole.

Each of the plurality of disc members may include a through hole formed at one position on the surface thereof, the first clamp includes a through hole connection part protruding so as to pass through the through hole, and a connection rod receipt part depressed into the through hole connection part, and the second clamp includes a connection rod inserted into the connection rod receipt part.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
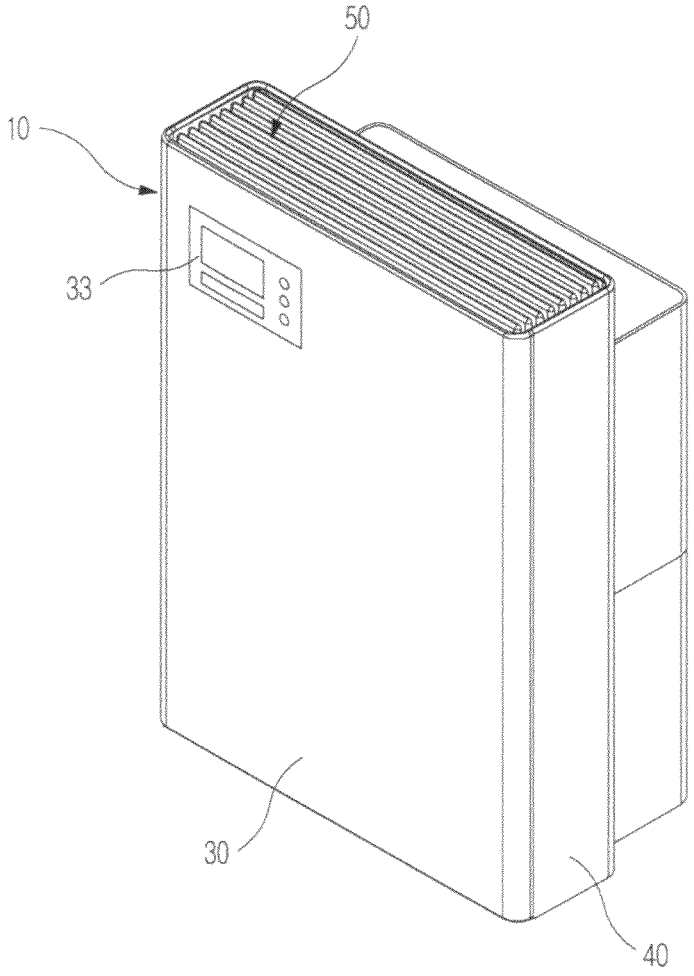
FIG. 1 is a perspective view illustrating the external appearance of a humidification apparatus in accordance with an embodiment.

Reference will now be made in detail to the embodiments, examples of which are illustrated in the accompanying drawings, wherein like reference numerals refer to like elements throughout.

Figure 2:
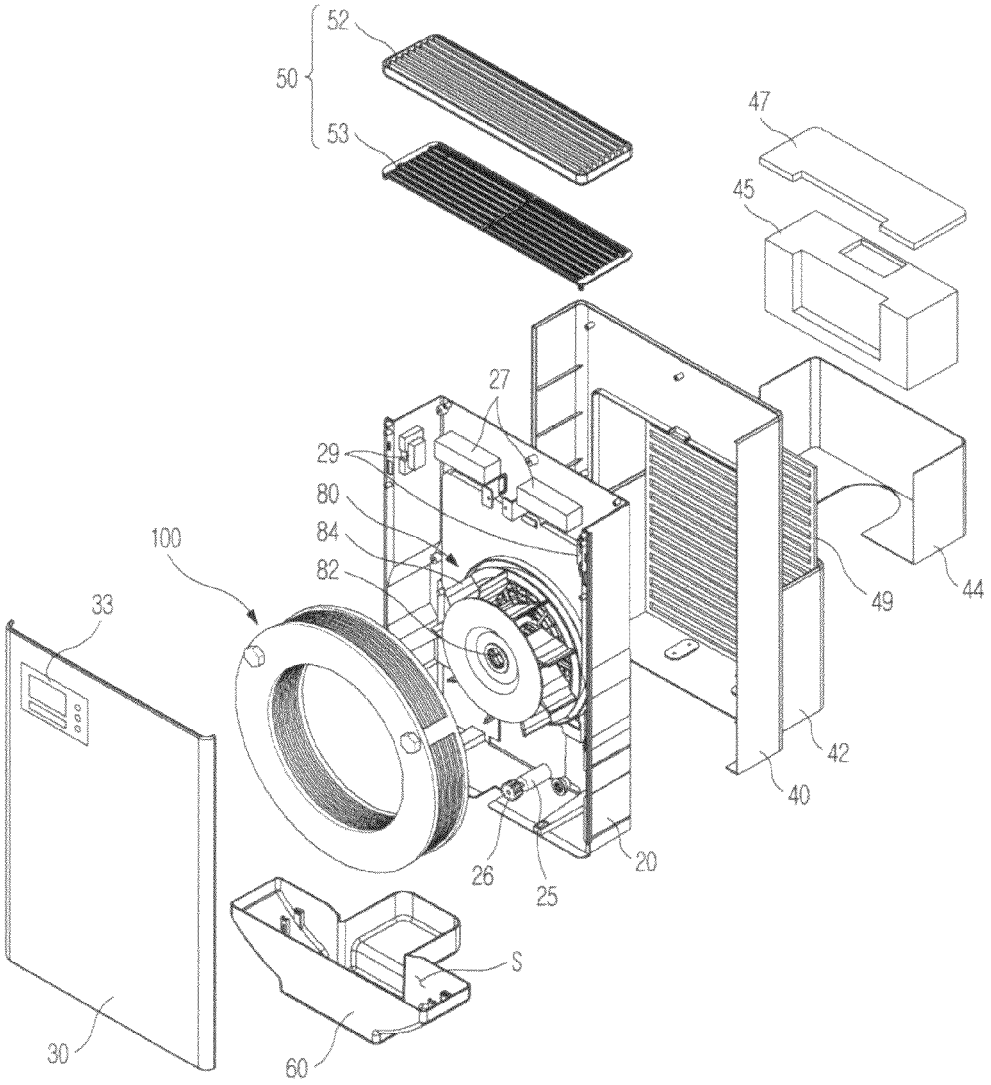
FIG. 2 is an exploded perspective view of the humidification apparatus of FIG. 1.

FIG. 1 is a perspective view illustrating the external appearance of a humidification apparatus in accordance with an embodiment, and FIG. 2 is an exploded perspective view of the humidification apparatus of FIG. 1.

As shown in FIGS. 1 and 2, a humidification apparatus in accordance with the embodiment includes a main body 10, a tub unit 60 disposed within the main body 10 to contain water, a disc assembly 100 rotated when a part of the disc assembly 100 is disposed in the tub unit 60, and an air blower device 80 to blow air to the disc assembly 100.

The main body 10 includes a frame part 20 forming a frame of the humidification apparatus, a front cover 30 forming the external appearance of the front surface of the humidification apparatus, a rear cover 40 forming the external appearance of the rear surface of the humidification apparatus, and a grill unit 50 forming air discharge holes on the upper surface of the main body 10.

Various parts including the disc assembly 100, the tub unit 60, and the air blower device 80 are installed on the frame part 20, and the frame part 20 serves as a frame to support the entirety of the humidification apparatus 1.

The tub unit 60 is a space to contain water, and a lower part of the disc assembly 30 is partially disposed in the inner space S of the tub unit 60, and thus is soaked. That is, the disc assembly 100 is soaked in water contained in the tub unit 60.

The disc assembly 100 has an approximately ring shape, and is rotated by a disc motor 25 installed at one side of the frame part 20. The disc motor 25 transmits driving force to a disc gear part 139 (with reference to FIG. 5) formed on the rear surface of the disc assembly 100 through a motor gear part 26 formed on a motor shaft.

A detailed description of the disc assembly 100 will be given later.

The air blower device 80 includes an air blower motor 82 to provide driving force, and an air blower fan 84 to receive the driving force from the air blower motor 82 and to generate an air flow using the driving force. The air blower fan 84 blows cool air upward and downward.

Heater units 27 are installed on the upper portion of the frame part 20. The heater units 27 serve to heat humidified air discharged to the outside, if necessary, so as to generate warm humidified air.

Further, a sterilization device 29 is installed on each of both side surfaces of the upper portion of the frame part 20. The sterilization devices 29 serve to exterminate harmful bacteria in the humidified air so as to discharge clean humidified air to the outside of the humidification apparatus.

The front cover 30 has an approximately rectangular shape, and is connected to the front surface of the frame part 20. The external surface of the front cover 30 may be decorated with various pictures or designs. Further, a control panel 33 to control operation of the humidification apparatus is provided at the upper portion of the front cover 30.

The control panel 33 is provided with various buttons, and thus allows a user to operate the humidification apparatus. The control panel 33 may be manipulated in a touch type as well as in a button type.

The rear cover 40 is connected to the rear surface of the frame part 20, and includes a water tank receipt part 42, which is a space to accommodate a water tank 45.

The water tank receipt part 42 is protruded from the rear surface of the rear cover 40 such that the upper surface of the water tank receipt part 42 is opened. An inner cover 44 is installed in the water tank receipt part 42, and the water tank 45 is accommodated on the inner cover 44 in the water tank receipt part 42.

The water tank 45 serves to store water necessary for humidification and then to supply a proper amount of the water to the tub unit 60, and is mounted on the humidification apparatus in a cassette type. When the water tank 45 is mounted on the humidification apparatus, the upper surface of the water tank 45 is covered with a water tank cover 47.

A filter 49 is installed on the rear inner surface of the water tank receipt part 42. The filter 49 serves to filter out impurities from air introduced from the outside.

The grill unit 50 is connected to the upper end of the main body 10, and is provided with the air discharge holes. The grill unit 50 includes an outer grill 52 installed on the outer side of the main body 10, and an inner grill 53 installed on the inner side of the main body 10.

Figure 3:
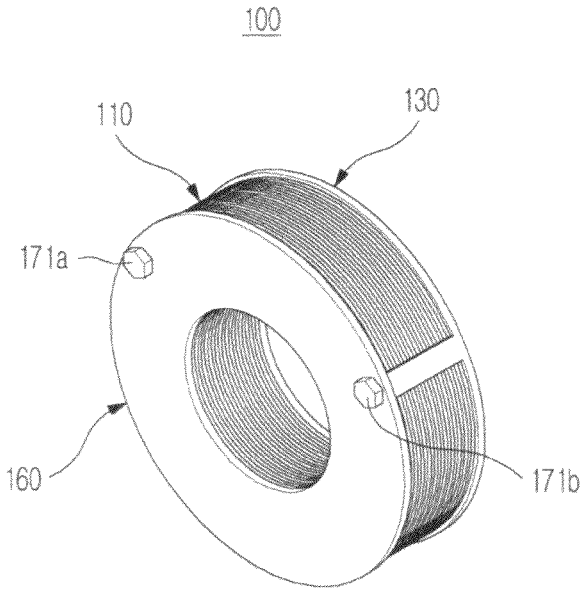
FIG. 3 is a perspective view illustrating the external appearance of a disc assembly in) : accordance with the embodiment.
Figure 4:
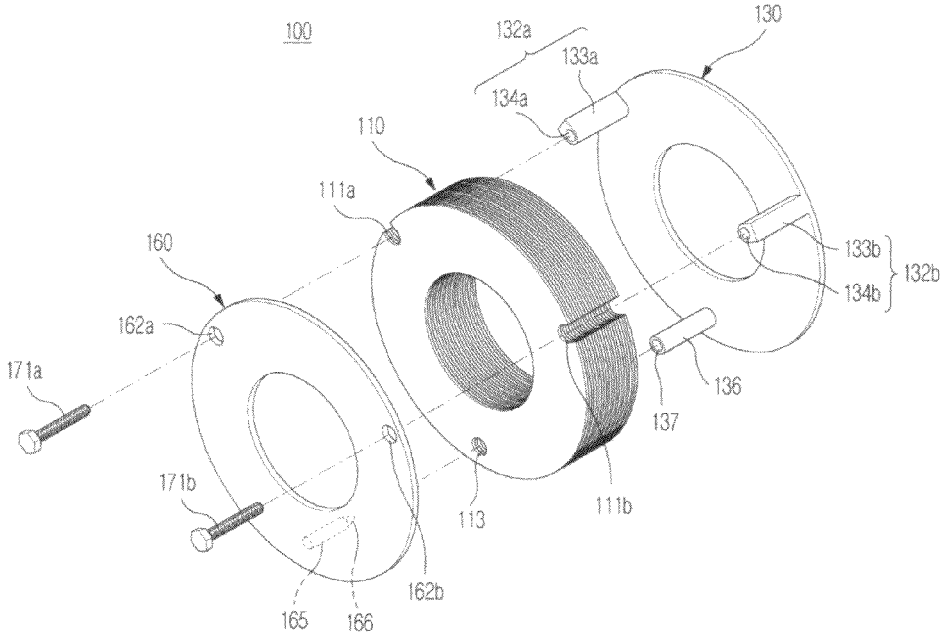
FIG. 4 is an exploded perspective view of the disc assembly of FIG. 3.
Figure 5:
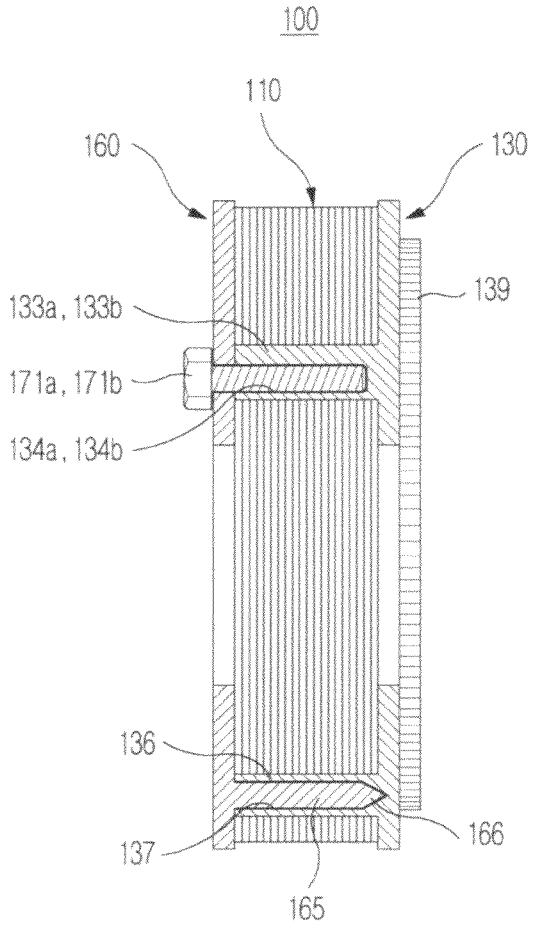
FIG. 5 is a longitudinal-sectional view of the disc assembly.
Figure 6A:
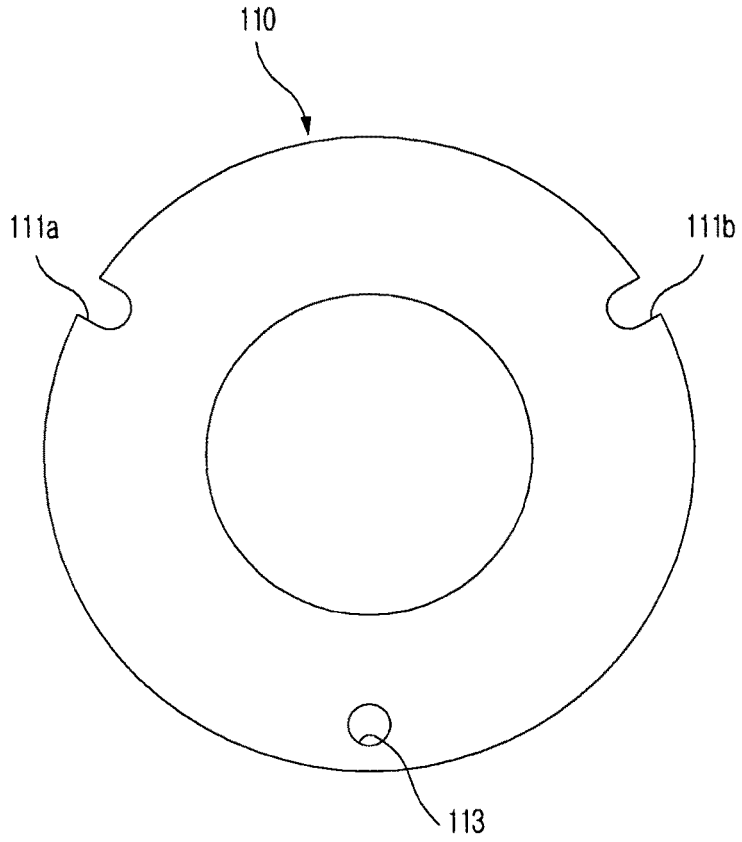
FIG. 6A is a front view of a disc member.
Figure 6B:
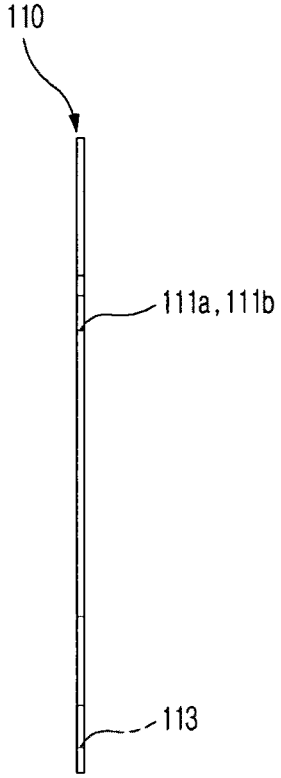
FIG. 6B is a side view of the disc member.
Figure 7A:
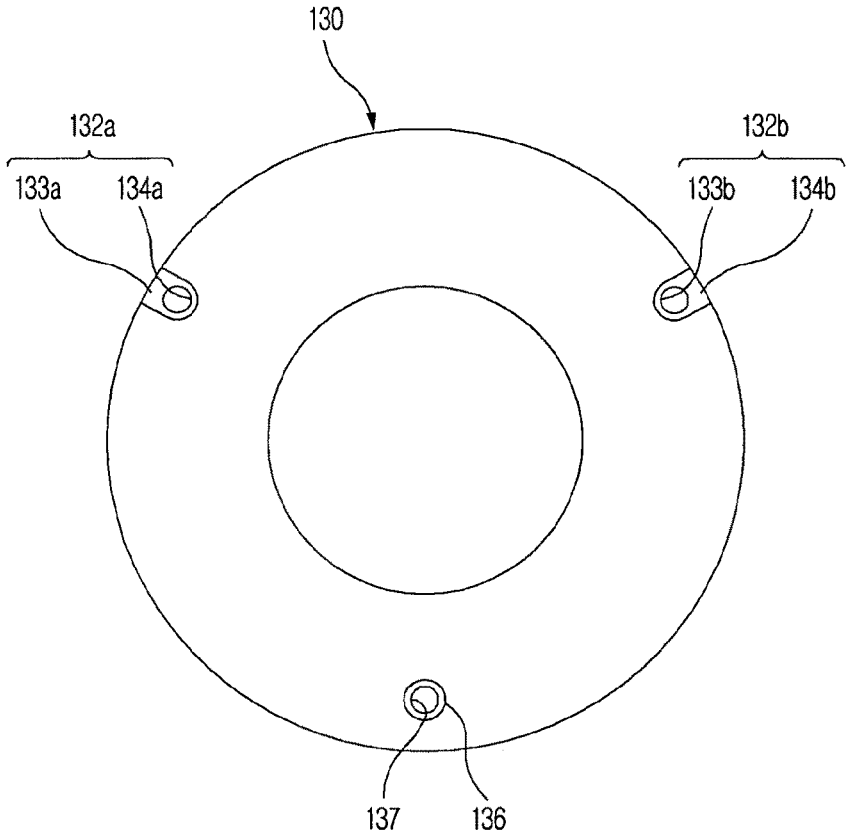
FIG. 7A is a front view of a first clamp.
Figure 7B:
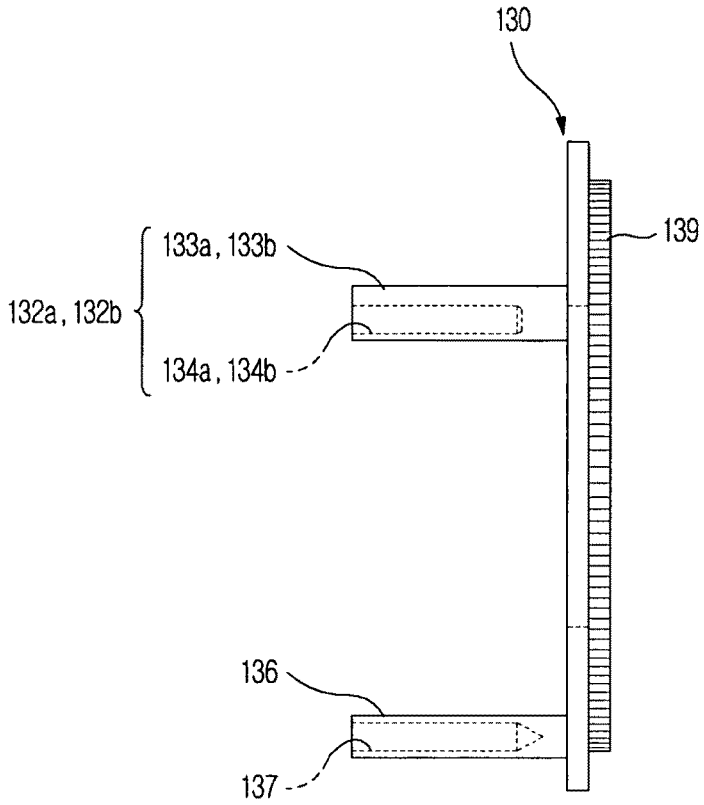
FIG. 7B is a side view of the first clamp.
Figure 8A:
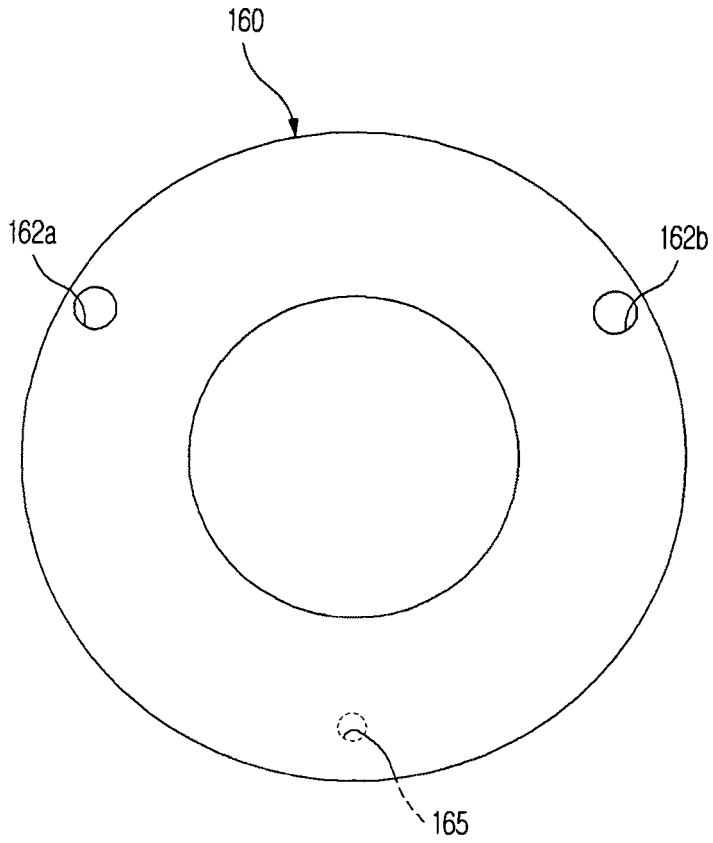
FIG. 8A is a front view of a second clamp.
Figure 8B:
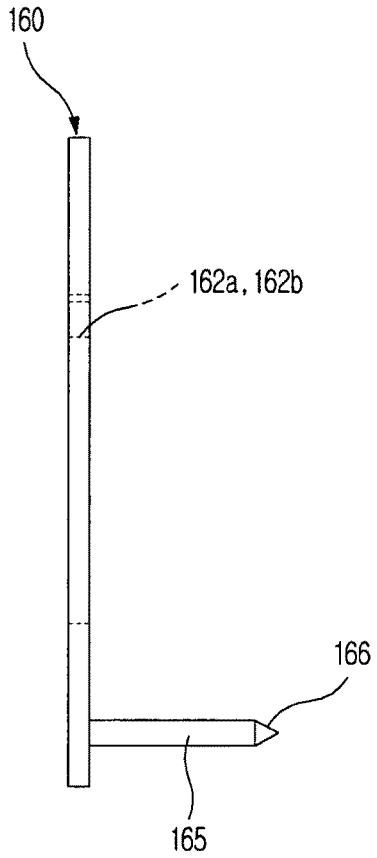
FIG. 8B is a side view of the second clamp.

FIG. 3 is a perspective view illustrating the external appearance of a disc assembly in accordance with the embodiment, FIG. 4 is an exploded perspective view of the disc assembly of FIG. 3, FIG. 5 is a longitudinal-sectional view of the disc assembly, FIG. 6A is a front view of a disc member, FIG. 6B is a side view of the disc member, FIG. 7A is a front view of a first clamp, FIG. 7B is a side view of the first clamp, FIG. 8A is a front view of a second clamp, and FIG. 8B is a side view of the second clamp.

As shown in FIGS. 3 to 5, the disc assembly 100 includes at least one disc member 110 assembled by stacking, a first clamp 130 disposed at one side of the disc member 110, and a second plate member 160 disposed at the other side of the disc member 110.

The disc member 110, as shown in FIGS. 4, 6A and 6B, has an approximately ring shape, and includes recess parts 111*a* and 111*b*, which are indented on the edge of the disc member 110.

The recess parts 111*a* and 111*b* are formed by removing parts of the edge of the disc member 110. If the recess parts 111*a* and 111*b* are formed on the edge of the ring-shaped disc member 110, when several disc members 110 are stacked, alignment for stacking of the disc members 110 may be easy, and when the first clamp 130 is inserted into the disc member 110, the first clamp 130 and the disc member 110 may be simply assembled without delicate manipulation.

The disc member 110 further includes a through hole 113 formed at one position on the surface of the disc member 110. A through hole connection part 136 of the first clamp 130, which will be described later, is inserted into the through hole 113.

The first clamp 130, as shown in FIGS. 4, 7A, and 7B, has an approximately ring shape, and includes at least one recess connection part, i.e., recess connection parts 132*a* and 132*b* in this embodiment, corresponding to the shape of the recess parts 111*a* and 111*b*, and the through hole connection part 136 inserted into the through hole 113.

The recess connection parts 132*a* and 133*b* are inserted into the recess parts 111*a* and 111*b* of the disc member 110, and thus serve to maintain the assembled shape of the disc assembly 110. The recess connection parts 132*a* and 132*b* respectively include disc member fixing parts 133*a* and 133*b* protruding in the stacking direction of the disc member 110, and screw connection parts 134*a* and 134*b* formed in the disc member fixing parts 133*a* and 133*b* such that screws 171*a* and 171*b* are connected thereto.

The through hole connection part 136 protrudes in the stacking direction of the disc member 110, and is inserted into the through hole 133 and thus fixes the disc member 110.

The first clamp 130 further includes a connection rod receipt part 137 depressed into the through hole connection part 136. The connection rod receipt part 137 is a space, into which a connection rod 165 of the second clamp 160, which will be described later, is inserted.

The second clamp 160, as shown in FIGS. 4, 8A, and 8B, includes screw holes 162*a* and 162*b* formed at positions corresponding to the recess parts 111*a* and 111*b* of the disc member 110 and the recess connection parts 132*a* and 132*b* of the first clamp 130, and the connection rod 165 formed at a position corresponding to the connection rod receipt part 137 of the first clamp 130.

The screw holes 162*a* and 162*b* serve as intermediates during a process of connecting the screws 171*a* and 171*b* to the screw connection parts 134*a* and 134*b* of the first clamp 130.

The connection rod 165 is inserted into the connection rod receipt part 137. Here, the connection rod 165 is inserted into the connection rod receipt part 137 when the through hole connection part 136 of the first clamp 130 is inserted into the through hole 113 of the disc member 110.

The connection rod 165 is provided with a tapered part 166 at the tip thereof. The tapered part 166 of the connection rod 165 allows the connection rod 165 to be easily inserted into the connection rod receipt part 137 without delicate manipulation.

Hereinafter, a process of assembling the disc assembly 100 in accordance with the embodiment will be described.

With reference to FIG. 4, the disc assembly 100 is easily assembled by connecting the first clamp 130, a plurality of disc members 110, and the second clamp 160.

First, the plural disc members 110 are stacked such that the recess parts 111*a* and 111*b* and the through holes 113 of the disc members 110 are respectively aligned with each other.

Thereafter, the recess connection parts 132*a* and 132*b* and the through hole connection part 136 of the first clamp 130 are respectively inserted into the recess parts 111*a* and 111*b* and the through holes 113 of the disc members 110.

Thereafter, the connection rod 165 of the second clamp 160 is inserted into the connection rod receipt part 137 of the first clamp 130, the screw holes 162*a* and 162*b* of the second clamp 160 are aligned with the screw connection parts 134*a* and 134*b* of the first clamp 130, and then the screws 171*a* and 171*b* are inserted into the screw holes 162*a* and 162*b* and are tightened. Thereby, assembly of the disc assembly 100 is completed.

On the other hand, disassembly of the first clamp 130, the plural disc elements 110, and the second clamp 160 is rapidly achieved by loosening the screws 171*a* and 171*b*.

Since the disc assembly 100 in accordance with the embodiment is assembled and disassembled via a simple process, as described above, a user may easily disassemble the disc assembly 100 so as to carry the disc assembly 10. Further, production efficiency of a product of the disc assembly 100 is improved.

Further, the above connection structure includes a minimized number of coupling parts, and an air flow becomes smooth.

The assembling process of the above-described disc assembly 100 may be carried out by a method in which the disc members 110 are inserted into the first clamp 130 one by one, and then the second clamp 160 is connected to the disc members 110 and the first clamp 130, or by any method causing the disc assembly 100 to be simply assembled.

Hereinafter, a process of operating the humidification apparatus in accordance with the embodiment will be described.

When a user mounts the water tank 45, filled with water, on the main body 10, water stored in the water tank 45 is supplied to the tub unit 60. When the tub unit 60 is filled with a proper amount of water, the supply of water is stopped, and as humidification is carried out, the tub unit 60 is replenished with water.

When the user operates the humidification apparatus by manipulating buttons of the control panel 33, the disc motor 25 is rotated, and then the disc assembly 100 connected thereto is rotated and is soaked in water contained in the tub unit 60.

Since the air blower device 80 is operated simultaneously with the rotation of the disc assembly 100, air at the outside of the humidification apparatus 1 is inhaled into the humidification apparatus 1 through the rear surface of the main body 10, impurities are filtered from the air by the filter 49, and then the clean air forms an air flow in the radial direction of the disc assembly 100.

At this time, the air absorbs moisture from the disc member 110, and thus holds humidity. The humidified air is directed to the upper portion of the main body 10.

Since the sterilization devices 29 at the upper portion of the main body 10 are operated, harmful bacteria are exterminated by the sterilization devices 29, and the humidified air is discharged to the outside of the main body 10 through the grill unit 50. Through the above process, humidification of indoor air is achieved. Here, the heater units 27 are operated, if it is necessary to heat air.

As is apparent from the above description, a humidification apparatus in accordance with one embodiment has a simple structure of a disc assembly, thereby allowing a user to easily assemble and disassemble the disc assembly during cleaning.

Further, the number of coupling parts of the disc assembly is minimized, and thus an air flow in the humidification apparatus becomes smooth.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. A humidification apparatus comprising:

a main body;

a tub unit to contain water;

a disc assembly rotated when a part of the disc assembly is disposed in the tub unit; and an air blower device to blow air to the disc assembly, wherein:

the disc assembly includes at least one disc member, a first clamp disposed at a first side of the at least one disc member, and a second clamp disposed at a second side of the at least one disc member; and each of the at least one disc members includes at least one recess part indented on the a circumferential edge thereof.

2. The humidification apparatus according to claim 1, wherein the first clamp includes at least one recess connection part formed corresponding to a shape of the at least one recess part.

3. The humidification apparatus according to claim 1, wherein:

each of the at least one disc members further includes a through hole formed at one position on the surface thereof; and the first clamp includes a through hole connection part protruding in the stacking direction of the at least one disc member so as to pass through the through hole.

4. The humidification apparatus according to claim 1, wherein each of the at least one disc members includes at least one recess part indented on an outer circumferential edge of the at least one disc member.

5. The humidification apparatus according to claim 2, wherein a shape of the at least one recess part is a U shape, and wherein each of the at least one disc members includes at least one recess part indented on the circumferential edge of the at least one disc member.

6. The humidification apparatus according to claim 4, wherein each of the at least one disc members includes at least two recess parts indented on the outer circumferential edge of the at least one disc members.

7. The humidification apparatus according to claim 1, wherein each of the at least one disk members comprises at least two disc members which includes at least two recess parts indented on the circumferential edge of the at least two disc members to respectively aligned each of the at least two disk members in parallel with each other.

8. A humidification apparatus comprising:

a main body;

a tub unit to contain water;

a disc assembly rotated when a part of the disc assembly is disposed in the tub unit; and an air blower device to blow air to the disc assembly, wherein:

the disc assembly includes at least one disc member, a first clamp disposed at a first side of the at least one disc member, and a second clamp disposed at a second side of the at least one disc member, wherein each of the at least one disc members includes at least one recess part indented on the edge thereof, and wherein the first clamp includes at least one recess connection part formed corresponding to a shape of the at least one recess part; and a screw wherein each of the at least one recess connection parts includes a disc member fixing part protruding in the stacking direction of the at least one disc member, and a screw connection part formed within the disc member fixing part such that the screw may be connected thereto.

9. The humidification apparatus according to claim 8, wherein:

the second clamp includes at least one screw hole formed corresponding to the position of the screw connection part; and the screw is connected to the screw connection part via the screw hole.

10. A humidification apparatus comprising:

a main body;

a tub unit to contain water;

a disc assembly rotated when a part of the disc assembly is disposed in the tub unit; and an air blower device to blow air to the disc assembly, wherein:

the disc assembly includes at least one disc member, a first clamp disposed at a first side of the at least one disc member, and a second clamp disposed at a second side of the at least one disc member, and each of the at least one disc members includes at least one recess part indented on the edge thereof, wherein:

each of the at least one disc members further includes a through hole formed at one position on the surface thereof; and the first clamp includes a through hole connection part protruding in the stacking direction of the at least one disc member so as to pass through the through hole, and wherein:

the first clamp further includes a connection rod receipt part depressed into the through hole connection part; and the second clamp includes a connection rod inserted into the connection rod receipt part.

11. The humidification apparatus according to claim 10, wherein the connection rod comprises a tapered part at the tip thereof inserted into the connection rod receipt part.

* * * * *

UNITED STATES PATENT AND TRADEMARK OFFICE

CERTIFICATE OF CORRECTION

PATENT NO. : 8,720,868 B2
APPLICATION NO. : 12/805679
DATED : May 13, 2014
INVENTOR(S) : Kim

It is certified that error appears in the above-identified patent and that said Letters Patent is hereby corrected as shown below:

In the Claims

Column 6, Line 60, Claim 1, delete "on the" and insert -- on --, therefor.

Signed and Sealed this
Thirtieth Day of September, 2014

Michelle K. Lee

Michelle K. Lee
*Deputy Director of the United States Patent and Trademark Office*